US007754407B2

(12) United States Patent
Moriya

(10) Patent No.: US 7,754,407 B2
(45) Date of Patent: Jul. 13, 2010

(54) TONER FOR DEVELOPING ELECTROSTATIC CHARGE IMAGES

(75) Inventor: Tohru Moriya, Shizuoka (JP)

(73) Assignee: Tomoegawa Co., Ltd., Tokyo (JP)

( * ) Notice: Subject to any disclaimer, the term of this patent is extended or adjusted under 35 U.S.C. 154(b) by 798 days.

(21) Appl. No.: 10/594,474

(22) PCT Filed: Mar. 24, 2005

(86) PCT No.: PCT/JP2005/005354

§ 371 (c)(1),
(2), (4) Date: Sep. 28, 2006

(87) PCT Pub. No.: WO2005/098547

PCT Pub. Date: Oct. 20, 2005

(65) Prior Publication Data

US 2007/0134582 A1 Jun. 14, 2007

(30) Foreign Application Priority Data

Mar. 31, 2004 (JP) ..... 2004-105531

(51) Int. Cl.
*G03G 9/087* (2006.01)

(52) U.S. Cl. ..... 430/109.3; 430/109.4

(58) Field of Classification Search ..... 430/109.4, 430/109.3

See application file for complete search history.

(56) References Cited

U.S. PATENT DOCUMENTS 6,916,588 B2 * 7/2005 Uosaki et al. ..... 430/109.3
7,378,206 B2 * 5/2008 Lee et al. ..... 430/109.3

FOREIGN PATENT DOCUMENTS

CN 1242085 A 1/2000
EP 0 978 766 B1 3/1997
JP A-09-080814 3/1997
JP 10073959 A * 3/1998
JP A-10-073959 3/1998
JP A-11-052612 2/1999
JP A-11-052614 2/1999
JP A-11-052615 2/1999
JP A-2001-272816 10/2001
JP A-2003-114546 4/2003
WO WO 02/062892 A1 8/2002

OTHER PUBLICATIONS

Partial English machine translation of JP 10-073959 (Mar. 1998).*
Partial English machine translation of JP 11-052615 (Feb. 1999).*
English language machine translation of JP 11-062615 (Feb. 1999).*
International Preliminary Report on Patentability of PCT/JP005/005354 dated Jan. 25, 2007.

* cited by examiner

*Primary Examiner*—Christopher RoDee
(74) *Attorney, Agent, or Firm*—Antonelli, Terry, Stout & Kraus, LLP.

(57) ABSTRACT

A toner for developing electrostatic charge images in which offset phenomenon and winding phenomenon do not occur in a wide temperature range, even if the binding resin contains the alicyclic olefinic resin, that is, a toner for developing electrostatic charge images which is superior in fixability in a high temperature range, and which is superior in melt contamination resistance, is provided.

In the toner for developing electrostatic charge images comprises at least binder resin and colorant, the binding resin containing alicyclic olefinic resin (A) and thermoplastic elastomer (B). It is preferable that the alicyclic olefinic resin (A) be a copolymer comprising cyclic olefin (A1) and an acyclic unsaturated monomer (A2) as an element. Additionally, it is preferable that the melting point of the thermoplastic elastomer (B) be 60 to 190° C.

9 Claims, No Drawings

TONER FOR DEVELOPING ELECTROSTATIC CHARGE IMAGES

TECHNICAL FIELD

The present invention relates to toners for developing electrostatic charge images, which are used in electrophotographic methods, electrographic recording methods, etc.

BACKGROUND ART

Generally, in image forming apparatuses such as copying machines, printers, etc., using electrophotographic technologies, a latent image is basically formed on a photoreceptor having photoconductivity, the latent image is developed by electrostatically adhering insulation toner in which frictional electrostatic charge is obtained by rubbing with a carrier or an electrification member which constitutes part of a development apparatus, and then the formed toner image is transferred onto a transfer medium such as ordinary paper, film, etc., and subsequently, a copy image or a printed image is formed by fixing the toner image using heat, pressure, solvent vapor, etc., can be used.

In such an image forming apparatuses, as a method for fixing toners, a heat-rolling fixing method is generally used, since thermal efficiency is high, and high-speed fixing can be carried out, and the like, can be employed. In this method, the toner is fixed by contacting a transfer paper with a heating-roller in a fixing machine having a heating-roller. However, the method has a problem, called "offset" in which a subsequent image is contaminated by some of the toner adhering to the surface of the heating-roller during fixing and by re-transferring onto the paper. Furthermore, the method also has a problem, called "winding" in which paper jamming is caused by the winding of the transfer paper on the surface of the heating-roller. Such phenomena are easily caused in the case in which the viscoelasticity of the toner which melted by the heating-roller is not suitable and the viscosity and elasticity of the toner are not balanced. The viscoelasticity of the toner depends on the type of binding resin which is the main component of the toner, and the type and content of other components.

As a binding resin which is the main component of the toner, styrene-acrylic resin and polyester resin are generally used; however, recently, alicyclic olefinic resin (cycloolefinic resin) is being considered. The alicyclic olefinic resin is anticipated as a binding resin which will replace styrene-acrylic resin and polyester resin because this resin has various superior characteristics such as colorlessness and transparency, low-temperature fixity and high-speed fixity obtained by superior heat characteristics, sharp molecular weight distribution, superior grindability (high productivity and sharp particle size distribution), low hygroscopicity, being nonpolluting, etc. However, the alicyclic olefinic resin has problems in that offset phenomenon and winding phenomenon are easily caused in fixing of the toner, and fixing characteristics in a high temperature range is not sufficient since the molecular weight distribution is generally narrow.

As a method for preventing the occurrence of the offset phenomenon or the winding phenomenon and for improving fixability in a high temperature range, a method in which mold lubricants such as waxes having low molecular weight are introduced in the toner has been used generally. However, in this method, the toner particles are melted and adhered to each other, or the melted toner is easily adhered to charging members of the developing device, and consequently, melt contamination resistance is easily deteriorated and a uniform image is prevented from forming. Furthermore, in this method, since in producing the toner it is not easy for the mold lubricant to be uniformly and finely dispersed in the binding resin, melt contamination resistance is easily deteriorated when dispersibility is low. In addition, the formability of the toner is not sufficient since molding conditions for improving the dispersibility, etc., is not easily selected. The greater the introduced amount of the mold lubricant, the more readily the above problems occur. Therefore, it is difficult to improve fixabilities such as regarding offset, winding, etc., without deteriorating properties such as melt contamination resistance, etc., merely by introducing the mold lubricant. Here, the formability is the ease of production of the toner particle in which dispersion of raw material is superior and crushing is easy.

Patent Publication 1 is Japanese Unexamined Patent Application Publication No. 2003-114546. Patent Publication 2 is Japanese Unexamined Patent Application Publication No. 2001-272816. Patent Publication 3 is Japanese Unexamined Patent Application Publication No. Hei 10-73959.

Japanese Unexamined Patent Application Publication No. 2003-114546 discloses a full color toner for oilless fixing in which at least cycloolefin copolymer resin is contained as a binding resin, wax added as mold lubricant is contained at a total amount of 7 to 20 weight % to toner particle weight, and glossiness of the print image plane is 15 or more. The cycloolefin copolymer resin is a copolymer of α-olefin (acyclic olefin in a broad sense) such as ethylene, propylene, butylene, etc., and alicyclic compound having a double bond (cycloolefin) such as cyclohexene, norbornene, tetracyclododecene, etc., and the cycloolefin copolymer can be obtained by a conventional polymerizing method in which a metallocene-based or a Ziegler-based catalyst is used. However, in this Patent Publication, since a low molecular weight component (wax) is contained at 7 to 20 weight % to toner particle weight, the toner particles are melted and adhered each other, or the melted toner is easily adhered to charging members of a developing device, and consequently, melt contamination resistance is easily deteriorated. Furthermore, in this method, since in producing the toner, it is not easy for a large volume of the low molecular weight component to be uniformly and finely dispersed in the binding resin, formability of the toner is not sufficient, and melt contamination resistance is easily deteriorated when dispersibility is low.

DISCLOSURE OF THE INVENTION

Problems Solved by the Invention

An object of the present invention is to provide a toner for developing electrostatic charge images in which offset phenomenon and winding phenomenon do not occur in a wide temperature range when a toner image formed by developing is fixed to a transfer paper by a common fixing device having a heating roller, even if the binding resin contains an alicyclic olefinic resin, that is, a toner for developing electrostatic charge images which is superior in fixability in a high temperature range.

Another object of the present invention is to provide a toner for developing electrostatic charge images which is superior in melt contamination resistance in addition to the fixability.

Means for Solving the Problems

The present inventor conducted research in order to solve the above problems, and as a result, he found that in a toner produced by melting and kneading at least alicyclic olefinic resin (A), thermoplastic elastomer (B), and a colorant, and by crushing and classifying the melted kneaded material, the temperature range in which the offset phenomenon and the winding phenomenon do not occur when fixing the toner is increased, and melt contamination resistance of the toner is improved and superior toner images can be formed, thereby accomplishing the present invention.

That is, the toner for developing electrostatic charge images of the present invention (hereinafter referred to as the "toner") comprises at least a binding resin and a colorant, wherein the binding resin contains an alicyclic olefinic resin (A) and a thermoplastic elastomer (B). It is preferable that the alicyclic olefinic resin (A) be a copolymer comprising a cyclic olefin (A1) and an acyclic unsaturated monomer (A2) as an element. It is preferable that the acyclic unsaturated monomer (A2) be an olefinic monomer. It is preferable that the thermoplastic elastomer (B) be at least one kind selected from an olefinic elastomer, polyamide elastomer, polyester elastomer, and styrenic elastomer. In addition, it is preferable that the melting point of the thermoplastic elastomer (B) be 60 to 190° C. It is preferable that the ratio (Ma/Mb) of a melt flow rate (Ma) of the alicyclic olefinic resin (A) and a melt flow rate (Mb) of the thermoplastic elastomer (B) be 0.1 to 20. It is preferable that the ratio ((A)/(B)) of the alicyclic olefinic resin (A) and the thermoplastic elastomer (B) be 70/30 to 99.5/0.5 by weight ratio. Furthermore, the toner of the present invention is suitable as a toner for a non-magnetic one-component developing method. Additionally, the toner of the present invention is suitable as a toner for full color.

Effects of the Invention

The toner of the present invention is a toner for developing electrostatic charge images which solves the above problem, and the viscoelastic property in the melted toner is suitable and fixability is superior since the binding resin contains an alicyclic olefinic resin (A) and a thermoplastic elastomer (B). Additionally, the toner of the present invention is also superior in melt contamination resistance in addition to the fixability.

BEST MODE FOR CARRYING OUT THE INVENTION

The toner of the present invention comprises at least a binding resin which contains an alicyclic olefinic resin (A) and a thermoplastic elastomer (B), and a colorant. In the following, these components will be explained in detail.

Alicyclic Olefinic Resin (A)

The alicyclic olefinic resin (A) contains at least one kind of cyclic olefin (A1) and the following polymers (a), (b), (c), etc., can be employed. The polymer (a) is a homopolymer consisting of one kind of cyclic olefin (A1), the polymer (b) is a copolymer consisting of two kinds or more of cyclic olefin (A1), and the polymer (c) is copolymer consisting of cyclic olefin (A1) and acyclic unsaturated monomer (A2).

As a cyclic olefin (A1), cyclic olefinic compounds having at least one double bond and polycyclic olefinic compounds such as monocyclic olefins such as cyclobutene, cyclopentene, cyclohexene, cycloheptene, cyclooctene, etc., or derivatives thereof, cyclic conjugate dienes such as cyclopentadiene, cyclohexadiene, cycloheptadiene, cyclooctadiene, etc., or derivatives thereof, polycyclic olefins such as norbornene, dicyclopentadiene, tricyclodecene, tetracyclododecene, hexacycloheptadecene, etc., or these derivatives, vinylalicyclic hydrocarbons such as vinylcyclobutane, vinylcyclobutene, vinylcyclopentane, vinylcyclopentene, vinylcyclohexane, vinylcyclohexene, vinylcycloheptane, vinylcycloheptene, vinylcyclooctane, vinylcyclooctene, etc., or these derivatives, hydrides of aromatic ring part in vinylaromatic monomer such as styrene, etc., or these derivatives, or the like, can be employed. These cyclic olefins (A1) can be used alone or in combination. As an above derivative, alkyl substitutes, alkylidene substitutes, alkoxy substitutes, acyl substitutes, halogen substitutes, carboxyl substitutes, etc., can be used. The number of carbon atoms which constitute the alicyclic structure is generally 4 to 30, is preferably 5 to 20, and is more preferably 5 to 15, from the viewpoint of formability and transparency.

The alicyclic olefinic resin (A) may be the homopolymer (a) consisting of one kind of cyclic olefin (A1) as an element and the copolymer (b) consisting of two kinds or more of cyclic olefin (A1) as an element; however, it is preferable that the resin (A) be the copolymer (c) consisting of cyclic olefin (A1) and acyclic unsaturated monomer (A2) as an element, from the viewpoint of grindability, workability, mechanical properties, etc.

The acyclic unsaturated monomer (A2) is not limited so long as it is an acyclic unsaturated monomer which can copolymerize with cyclic olefin (A1); however, as an acyclic unsaturated monomer (A2), for example, olefinic monomers; acrylic acid monomers; acrylate monomers such as acrylic acid $C_{1-6}$ alkyl ester of methyl acrylate, ethyl acrylate, butyl acrylate, etc.; vinyl ester monomers such as vinyl acetate, vinyl propionic acid, etc.; vinyl cyanide monomers such as acrylonitrile, etc.; diene monomers such as butadiene, 1,4-pentadiene, isoprene, etc.; can be employed. These acyclic unsaturated monomers (A2) can be used alone or in combination. It is preferable that the acyclic unsaturated monomer (A2) be an olefinic monomer from the viewpoint of flexibility of the toner. Here, acrylic acid monomers, acrylate monomers, vinyl ester monomers, and vinyl cyanide monomers contain monomers in which a group at the α-position is substituted for alkyl group such as methyl, ethyl, butyl, etc.

As an olefinic monomer, for example, an α-$C_{2-10}$ olefin (preferably α-$C_{2-6}$ olefin, and more preferably α-$C_{2-4}$ olefin) such as ethylene, propylene, 1-butylene, 1-pentene, 1-hexene, 1-heptene, 1-octene, etc., and a branched-chain olefin such as isobutene, isoprene, etc., can be employed. These can be used alone or in combination. Of these olefins, ethylene and propylene are preferable.

An amount of the acyclic unsaturated monomer (A2) to be used can be selected from the range of 0 to 100 mol, preferably 0 to 90 mol, and more preferably 0 to 80 mol to 100 mol of cyclic olefin (A1).

Specifically, a copolymer of ethylene or propylene and norbornene (ethylene-norbornene copolymer, propylene-norbornene copolymer, etc.) can be preferably employed as alicyclic olefinic resin (A), and it is preferable that it have no unsaturated double bond and that it be colorless and transparent and have high light transmittance.

In the alicyclic olefinic resin (A), it is preferable that the content of the low molecular weight component, in which molecular weight measured by a gel permeation chromatography (GPC) is 40,000 or more, be 10 to 40 weight %, and the content of the high molecular weight component, in which the molecular weight is 400,000 or more, be 5 to 20 weight %. In the case in which the content of each molecular weight component deviates from the above range, formability, transparency, etc., may not be sufficiently obtained. The GPC measuring devices used were the JASCO GULLIVER SERIES AS-950 and PU-980, manufactured by JASCO Corporation.

Glass transition temperature of the alicyclic olefinic resin (A) depends on the composition ratio of the cyclic olefin (A1)

and the acyclic unsaturated monomer (A2), and it is generally 50 to 200° C., and it can be properly selected according to application and forming temperature. For the toner, it is 50 to 80° C., is preferably 50 to 70° C., and is more preferably 50 to 65° C. In the case in which the glass transition temperature of the alicyclic olefinic resin (A) exceeds 80° C., fixability is deteriorated, and in addition, formability of the toner is not sufficient, since rigidity and impact resistance are increased, and in contrast, in the case in which it is under 50° C., fixability is deteriorated and in addition, melt contamination resistance is inferior.

In the alicyclic olefinic resin (A), carboxyl group, hydroxyl group, amino group, etc., may be introduced by a known method. Furthermore, in an alicyclic olefinic resin (A) introduced carboxyl group, a crosslinked structure may be introduced by adding metal such as zinc, copper, calcium, etc. By introducing these substituents or the metal crosslinked structure, fixability is improved, and in addition, formability of the toner is also improved, since mixing properties of the other resin such as thermoplastic elastomer (B), etc., and the colorant is improved in producing toner.

Thermoplastic Elastomer (B)

The thermoplastic elastomer (B) is composed of a hard component and a soft component, and for example, olefinic elastomers, styrenic elastomers, vinyl chloride elastomers, urethane elastomers, polyamide elastomers, polyester elastomers, fluorine elastomers, silicone elastomers, isoprene elastomers, butadiene elastomers, nitrile butadiene elastomers, chlorinated polyethylene elastomers, chloroprene elastomers, etc., can be used.

The thermoplastic elastomers (B) can be used alone or in combination. For the above thermoplastic elastomer (B), olefinic elastomers, polyamide elastomers, polyester elastomers, polystyrene elastomers, can be preferably used.

As an olefinic elastomer, elastomers in which the hard component is composed of α-olefinic monomer, and the soft component is composed of olefinic rubber such as ethylene-α-olefinic copolymer (ethylene-propylene rubber (EPR), ethylene-butylene rubber (EBM), etc.) and ethylene-α-olefin-diene copolymer (ethylene-propylene-diene rubber (EPDM), etc.), etc., or the like, can be employed. The above olefinic rubber may be partially cross-linked.

As an α-olefinic monomer which constitutes the hard component, α-$C_{2-10}$ olefin such as ethylene, propylene, 1-butene, 1-hexene, 1-pentene, 1-octene, 1-decene, etc., and preferably α-$C_{2-4}$ olefin (in particular, ethylene and propylene), can be used.

As an α-olefinic monomer which constitutes the soft component, an α-$C_{2-10}$ olefin such as ethylene, propylene, 1-butene, 1-hexene, 1-pentene, 1-octene, 1-decene, etc., and preferably an α-$C_{3-4}$ olefin (in particular, propylene), can be used. As a diene which constitutes the soft component, dicyclopentadiene, 1,4-hexadiene, cyclooctadiene, methylene norbornene, ethylidene norbornane, 7-methyl-1,6-octadiene, etc., can be used. Furthermore, the ethylene-α-olefin-diene copolymer can have a branched structure, and 1,9-decadiene, norbornadiene, etc., can be used as a preferable suitable diene.

In addition, as an olefinic elastomer, polymerized elastomer formed by polymerizing the soft component and the hard component, a blended elastomer formed by blending the soft component and the hard component, cross-linked elastomer formed by blending the hard component and cross-linking EPDM, etc., and the like, can be employed.

As a polyamide elastomer, elastomers in which the hard component is composed of polyamide unit and the soft component is composed of aliphatic polyether or polyester unit, etc., can be used.

As a polyamide unit which constitutes the hard component, nylon-6, nylon-66, nylon-610, nylon-11, nylon-12, etc., can be employed, and nylon-6 and nylon-12 are preferable.

As an aliphatic polyether which constitutes the soft component, for example, poly $C_{2-6}$ alkylene oxide such as polyethylene oxide, polypropylene oxide, polytetramethylene oxide, etc., can be employed, and as an aliphatic polyester, for example, polyester of aliphatic $C_{2-6}$ dicarboxylic acid (for example, oxalic acid, succinic acid, adipic acid, etc.) and aliphatic $C_{2-6}$ diol (for example, ethylene glycol, propylene glycol, 1,4-butanediol, 1,3-butanediol, neopentyl glycol, hexanediol, etc.), etc., can be used.

As a polyester elastomer, elastomers in which the hard component is composed of alkylenearylate unit and the soft component is composed aliphatic polyether or polyester unit, etc., can be employed.

As an alkylenearylate which constitutes the hard component, $C_{2-4}$ alkylene terephthalate such as ethylene terephthalate, butylene terephthalate, etc., and $C_{2-4}$ alkylene naphthalate such as ethylene naphthalate, butylene naphthalate, etc., and preferably $C_{2-4}$ alkylene terephthalate (in particular, butylene terephthalate), etc., can be employed.

As an aliphatic polyether which constitutes the soft component, for example, a poly $C_{2-6}$ alkylene oxide such as polyethylene oxide, polypropylene oxide, polytetramethylene oxide, etc., can be employed, and as an aliphatic polyester, for example, a polyester of aliphatic $C_{2-6}$ dicarboxylic acid (for example, oxalic acid, succinic acid, adipic acid, etc.) and aliphatic $C_{2-6}$ diol (for example, ethylene glycol, propylene glycol, 1,4-butanediol, 1,3-butanediol, neopentyl glycol, hexanediol, etc.), etc., can be used.

As a styrenic elastomer, elastomers in which the hard component is composed of a styrenic unit and the soft component is composed of a diene unit, for example, styrene-diene block copolymer or hydrogenate thereof, etc., can be employed. As a styrene-diene block copolymer or hydrogenate thereof, styrene-butadiene block copolymer, hydrogenated styrene-butadiene block copolymer, styrene-butadiene-styrene block copolymer (SBS), hydrogenated styrene-butadiene-styrene block copolymer (SEBS), styrene-isoprene block copolymer, hydrogenated styrene-isoprene block copolymer (SEP), styrene-isoprene-styrene block copolymer (SIS), hydrogenated styrene-isoprene-styrene block copolymer (SEPS), etc., can be employed. In the block copolymer, a terminal block may be composed of any one of a styrene block or a diene block.

In connection with the above elastomers, the olefinic elastomer and the polyamide elastomer may be used alone from the viewpoint of compatibility and formability, and in contrast, it is preferable that the polyester elastomer and the styrenic elastomer be used in combination with the olefinic elastomer or the polyamide elastomer. Amounts of the polyester elastomer and the styrenic elastomer to be used is preferably 50% or less, is more preferably 40% or less, and is most preferably 30% or less, relative to total weight of the thermoplastic elastomer.

In each of the above elastomers, ratio (weight ratio) between the hard component and the soft component is hard component/soft component=95/5 to 30/70, is preferably 90/10 to 50/50, and is more preferably 90/10 to 60/40 (in particular, 90/10 to 70/30). In the case in which the proportion between the hard component and the soft component is in the above range, both of the formability and the mechanical property are superior.

The melting point of the thermoplastic elastomer (B) can be properly selected from 60 to 190° C., preferably 80 to 180° C., more preferably 100 to 180° C., and most preferably 140 to 180° C. In the case in which the melting point is under 60° C., the melting of the toner elasticity is remarkably decreased and fixability is deteriorated, and in addition, melt contamination resistance is also deteriorated, and in contrast, in the case in which the melting point exceeds 190° C., in melting the toner, the thermoplastic elastomer is not sufficient melted and fixability is decreased, and in addition, in producing the toner, the alicyclic olefinic system resin (A) and the thermoplastic elastomer (B) are not sufficiently mixed and formability of the toner is also decreased.

Here, measurement of the melting point is carried out by using the following method according to ASTM: D3418-82. About 5 mg of sample is weighed and placed in a cell made of aluminum, the cell is placed in a differential scanning calorimeter (DSC) (produced by Seiko Instruments Inc., trade name: SCC-5200), and $N_2$ gas is blown therein at 50 ml per minute. Then, the cell is heated from 20° C. to 220° C. at a heating rate of 10° C./min, it is incubated at 220° C. for 10 minutes, and it is cooled from 220° C. to 20° C. at a cooling rate of 10° C./min, and next, a second heating is carried out under the above conditions, and the temperature of the top of an endothermic peak which appears at a highest temperature during the heating, is defined as a melting point of the present invention.

The toner of the present invention is composed of at least binding resin containing alicyclic olefinic resin (A) and thermoplastic elastomer (B) and colorant.

Ratio (weight ratio) of the alicyclic olefinic resin (A) and the thermoplastic elastomer (B) can be selected from a range of (A)/(B)=70/30 to 99.9/0.1, preferably 70/30 to 99.5/0.5, and more preferably 80/20 to 99/1 (in particular, 90/10 to 99/1). In the case in which the ratio of the thermoplastic elastomer is too low, elasticity of the toner is decreased and fixability is deteriorated, and in contrast, in the case in which it is too high, formability of the toner is decreased and production cost is increased.

Ratio (Ma/Mb) of melt flow rate between melt flow rate (Ma) of the alicyclic olefinic resin (A) and melt flow rate (Mb) of the thermoplastic elastomer (B) can be selected from a range of 0.05 to 20, preferably 0.1 to 20, and more preferably 0.1 to 10. In the case in which the ratio of the melt flow rate deviates from the above range, the alicyclic olefinic resin (A) and the thermoplastic elastomer (B) are not easily mixed and formability of the toner is decreased.

Measurement of the melt flow rate is carried out by the following method. Using a flow tester (trade name CF-500, produced by Shimadzu Corporation), the toner is heated under conditions of a temperature of 200° C. and load of 50 N, and the weight of resin flowing out in 1 minute is measured, and the melt flow rate is calculated by the measured value.

As a colorant for the toner of the present invention, black pigments can be used for black toners, and pigments for magenta, pigments for cyan, pigments for yellow, etc., can be used at for color toners.

As a pigment for black, carbon black can be generally used. The carbon black can be used without limitations of numbers average particle size, oil absorption, pH, etc., and the following carbon black can be used as a commercial product. For example, those with the trade names REGAL 400, 660, 330, 300, and SRF-S, STERLING SO, V, NS, and R, produced by U.S.A. Cabot Corporation; those with trade names RAVEN H20, MT-P, 410, 420, 430, 450, 500, 760, 780, 1000, 1035, 1060, and 1080, produced by Colombia Carbon Japan Co., Ltd.; and those with trade names #5B, #10B, #40, #2400B, MA-100, produced by Mitsubishi Chemistry Co., Ltd., etc., can be used. These carbon blacks can be used alone or in combination.

Content of the carbon black in the toner of the present invention can be selected from a range of 0.1 to 20 weight %, preferably 1 to 10 weight %, and more preferably 1 to 5 weight % (in particular, 1 to 3 weight %). In the case in which the ratio of the carbon black is too low, image density is decreased, and in contrast, in the case in which it is too high, picture quality is easily decreased and toner formability is also reduced. As a pigment for black, black magnetic powders such as iron oxide, ferrite, etc., can be employed, in addition to the carbon black.

As a magenta pigment, C. I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C. I. pigment violet 19; C. I. violet 1, 2, 10, 13, 15, 23, 29, 35, etc., can be employed. These magenta pigments can be used alone or in combination.

As a cyan pigment, C. I. pigment blue 2, 3, 15, 16, 17; C. I. vat blue 6; C. I. acid blue 45, etc., can be employed. These cyan pigments can be used alone or in combination.

As a yellow pigment, C. I. pigment yellow 1, 2, 3, 4, 5, 6, 7, 10, 11, 12, 13, 14, 15, 16, 17, 23, 65, 73, 74, 83, 93, 94, 97, 155, 180, etc., can be employed. These yellow pigments can be used alone or in combination.

As a color pigment for full color, C.I. pigment red 57 and 122 of magenta pigment, C.I. pigment blue 15 of cyan pigment, C.I. pigment yellow 17, 93, 155, and 180 of yellow pigment, can be preferably used, from the viewpoint of color mixing and color reproducibility.

Content of the color pigment in the toner of the present invention can be selected from a range of 1 to 20 weight %, preferably 3 to 10 weight %, and more preferably 4 to 9 weight % (in particular, 4.5 to 8 weight %). In the case in which the content of these pigments is lower than the above range, image concentration is decreased, and in contrast, in the case in which it is too high, charge stability is deteriorated and picture quality is easily decreased. Additionally, production cost is increased.

In addition, masterbatches in which the color pigments are dispersed beforehand in resin which can be a binding resin at a high density may be used.

In the toner of the present invention, change control agents, low molecular weight components (waxes), etc., may be added, as necessary.

The charge control agent contains a positive charge control agent and a negative charge control agent.

As a positive charge control agent, for example, compounds modified by nigrosin fatty acid metal salt, etc.; quaternary ammonium salts such as tributylbenzyl ammonium-1-hydroxy-4-naphthosulfonate, tetrabutyl ammonium tetrafluoroborate, etc.; di-organo oxides such as dibutyl tin oxide, dioctyl tin oxide, dicyclohexyl tin oxide, etc.; di-organo tin borates such as dibutyl tin borate, dioctyl tin borate, dicyclohexyl tin borate, etc.; pyridium salts; azines; triphenylmethane compounds; low molecular weight polymers having a cationic functional group; and the like, can be employed. These positive charge control agents can be used alone or in combination. Of these positive charge control agents, nigrosin compounds and quaternary ammonium salts can be preferably used.

As a negative charge control agent, for example, organometallic compounds such as acetylacetone metal complex, monoazo metal complex, naphthoic acid metal complex or salt thereof, salicylic acid metal complex or salt thereof, chelate compounds, low molecular weight polymers having an anionic functional group, and the like, can be used. These negative charge control agents can be used alone or in combination. Of these negative charge control agents, salicylic acid metal complex and monoazo metal complex can be preferably used.

Content of the charge control agent for the toner can be typically selected from 0.1 to 5 weight %, preferably 0.5 to 4 weight %, and more preferably 1 to 4 weight %. In addition, it is preferable that the charge control agent for color be colorless or of a light color.

It is preferable that the toner of the present invention contain waxes as a mold lubricant.

As a wax, polyolefin based wax such as polyethylene wax, polypropylene wax, modified polyethylene wax, etc., synthesized wax such as Fischer-Tropsch wax, etc., petroleum wax such as paraffin wax, microcrystalline wax, etc., carnauba wax, candelilla wax, rice wax, hydrogenated castor oil, or the like, can be employed.

These waxes can be used alone or in combination. Content of the wax can be selected from 0.1 to 10 weight %, preferably from 0.5 to 7 weight %, and more preferably from 1 to 5 weight %, in the toner. In the case in which the content is above the above range, melt contamination resistance and toner formability are deteriorated, and in contrast, in the case in which the content is below the above range, releasability is not sufficient and fixability is deteriorated.

In the toner of the present invention, a magnetic material, for example, a metal such as cobalt, iron, nickel, etc.; an alloy of aluminum, copper, iron, nickel, magnesium, tin, zinc, gold, silver, selenium, titanium, tungsten, zirconium or other metals; a metal oxide such as aluminum oxide, iron oxide, nickel oxide, etc.; ferrite; magnetite; and the like, can be used as necessary. Content of the magnetic material is usually from 1 to 70 weight %, preferably from 5 to 50 weight %, and more preferably from 10 to 40 weight %, relative to the toner. Average particle diameter of the magnetic material is preferably from 0.01 to 3 μm.

In the toner of the present invention, various additives, for example, stabilizers (for example, ultraviolet light absorbing agents, antioxidants, thermal stabilizers, etc.), fire retardants, anti-haze agents, dispersing agents, core agents, plasticizers (phthalic ester, fatty acid plasticizer, phosphoric acid plasticizer, etc.), high molecular antistatic agents, low molecular antistatic agents, compatibility accelerators, conductive agents, fillers, fluidity improving agents, and the like, may be further added as necessary.

In the toner of the present invention, other resins, for example, styrenic resin, acrylic resin, styrene-acrylic copolymer resin, olefinic resin (for example, α-olefin resins such as polyethylene, polypropylene, etc.), vinyl resins (for example, polyvinylchloride, polyvinylidene chloride, etc.), polyamide resins, polyether resins, urethane resins, epoxy resins, polyphenylene oxide resins, terpene phenol resins, polylactic acid resins, hydrogenated rosin, cyclized rubber, thermoplastic polyimide, and the like, may be further added as part of the binding resin as necessary. An added amount of the resin can be selected from a range of 30 weight % or less to 100 weight % of the binding resin.

The toner of the present invention has various superior properties which the alicyclic olefinic resin has, such as colorlessness and transparency, superior thermal properties (low-temperature fixability, high-speed fixability), sharp molecular weight distribution, superior grindability (high productivity and sharp particle diameter distribution), low hygroscopicity, and safety of being non-polluting, since the binding resin contains alicyclic olefinic resin (A) and thermoplastic elastomer (B), and in addition, by containing the thermoplastic elastomer, balance of viscoelasticity, mechanical property, and rheological property are superior, and superior fixability at a high temperature range is also exhibited. Furthermore, the toner for developing electrostatic charge images of the present invention is also superior in melt contamination resistance. In addition, the toner for developing electrostatic charge images of the present invention is also superior in formability of the toner, and it is advantageous in producing the toner.

It is preferable that inorganic fine particles adhere on the surface on the toner of the present invention from the viewpoint of addition of the fluidity. As an inorganic fine particle, silica, alumina, talc, clay, calcium carbonate, magnesium carbonate, titanium oxide, carbon black powder, magnetic powder, etc., can be employed. These inorganic fine particles can be used alone or in combination. Of these inorganic fine particles, silica can be preferably used.

The silica can be properly selected according to application without limitation of average particle diameter, BET specific surface, surface treatment, etc.; however, it is preferable that the BET specific surface be in a range from 50 to 400 $m^2/g$ and the silica be surface-treated hydrophobic silica.

In the toner of the present invention, resin fine powder such as polytetrafluoroethylene resin powder, polyvinylidene fluoride resin powder, etc., may be adhered, in addition to the above inorganic fine particles. An added amount of the inorganic fine particle and the resin fine powder can be properly selected from a range of 0.01 to 8 weight parts, preferably 0.1 to 5 weight parts, and more preferably 0.1 to 4 weight parts (in particular, 0.3 to 3 weight parts), to 100 weight parts of the toner. In the case in which the added amount deviates from the above range, fluidity and electrification stability of the toner are decreased, and it is difficult to form uniform images.

The toner of the present invention is not limited as to developing method, and it can be used for a non-magnetic one-component developing method, a magnetic one-component developing method, a two-component developing method, or other developing methods. The toner for the magnetic one-component developing method is used as a magnetic toner by mixing the magnetic powder described above in the binding resin, and the toner for the two-component developing method is used by mixing with the carrier. The toner for the non-magnetic one-component developing method is preferably used from the viewpoint of simplicity of apparatus and production cost.

As a carrier used by the two-component developing method, for example, nickel, cobalt, iron oxide, ferrite, iron, glass bead, etc., can be used. These carriers can be used alone or in combination. It is preferable that the average particle diameter of the carrier be 20 to 150 μm. In addition, the surface of the carrier may be covered by coating materials such as fluorine resins, acrylic resins, silicone resins, etc.

The toner of the present invention may be a toner for monochrome or may be a toner for full color. In the toner for monochrome, as a colorant for non-magnetic toner, carbon black described above can be used, and as a colorant for magnetic toner, black magnetic powders of the magnetic powders described above can be used in addition to the carbon black described above. In the toner for full color, as a colorant, the pigments for color described above can be used.

Production Method of Toner

The production method for the toner of the present invention is not limited; however, melt-kneaded material is usually produced by dry-blending binding resin, colorant and other additives, and heat-kneading, and then toner having desired particle size and particle shape can be produced by crushing and classifying the melt-kneaded material. The production method of the toner may be a method in which toner particles are produced by polymerizing binding resin.

As a dry-type blending method, methods using mixing machines such as Henschel mixers, super mixers, ribbon mixers, etc., may be mentioned.

As a heat-melting and kneading method, various methods, for example, common methods such as methods using a biaxial extruder, methods using a Banbury mixer, methods using a pressure roller, methods using a pressure kneader, etc., can be used. The method using a biaxial extruder is preferable as a heat-melting and kneading method from the viewpoints of formability and generality. The melt-kneaded material is obtained by melting and kneading using a biaxial extruder and by pushing it out from a mouthpiece (die) of the tip of the biaxial extruder. The kneading temperature of the biaxial extruder is 50 to 220° C., is preferably 70 to 200° C., and is more preferably 80 to 180° C.

The alicyclic olefinic resin (A) and the thermoplastic elastomer (B) used in the present invention are superior in formability in production since superior dispersibility of each material component in heat-melting and kneading is considered.

As a crushing method, a crushing method using mills such as a hammer mill, cutter mill, jet mill, etc., can be employed.

In addition, as a classification method, air flow classifiers such as a dry-type centrifugal classifier can be generally used.

The volume average particle size of the toner as produced above is usual about 6 to 10 μm, is preferably 6 to 9 μm, and is more preferably 6 to 8 μm. The volume average particle size is volume 50% diameter measured using particle size distribution measuring device (trade name: Multisizer II, manufactured by Beckman Coulter Co., Ltd.).

The inorganic fine particles and the resin fine powders described above may be adhered on the surface of the toner by agitating, using mixing machines such as turbine agitators, Henschel mixers, super mixers, etc.

EXAMPLES

In the following, effects of the present invention are explained in detail by Examples based on the present invention; however, the present invention is not limited by these Examples. In the following, material components used in Examples and Comparative Examples, measuring methods of physical properties, and evaluation methods for the toners are given.

Material Component

Binding Resin

CO: alicyclic olefinic resin (ethylene-norbornene copolymer, produced by Ticona GmbH, trade name: TOPAS COC, weight average molecular (Mw): 200,000, number average molecular weight (Mn): 5,000, and Mw/Mn: 40)

TPO: thermoplastic olefinic elastomer (hard component: polypropylene, soft component: ethylene-propylene rubber, melting point 155° C., produced by Idemitsu Petrochemical Co., Ltd., trade name: R110E)

TPEE: thermoplastic polyester elastomer (hard component: polybutylene terephthalate, soft component: polyether, melting point: 163° C., produced by Du Pont-Toray Co., Ltd., trade name: Hytrel 4057)

Colorant

PIG.: cyanogen pigment for toner C. I. pigment blue 15:3 (produced by Clariant (Japan) K. K., trade name: Hostaperm Blue B2G)

Charge Control Agent

CCA: zinc salt type of electrification control agent (produced by Orient Chemical Industries, Ltd., trade name: BONTRONE-84)

Mold Lubricant

WAX: carnauba wax (produced by S. Kato & Co., trade name: Carnauba wax No. 2 powder)

Evaluation Method of Toner

1. Fixability 4 weight parts of toner and 96 weight parts of non-coat ferrite carrier (produced by Powdertech Co., Ltd., trade name: FL-1020) were mixed and a two-component developer was produced.

Next, a strip unfixed image having a length of 3 cm and a width of 6 cm was formed on an A4 transfer paper using a commercial copying machine (trade name: SF-9800, produced by Sharp Corporation), using this developer. The amount of toner adhered on the transfer paper was adjusted at 2.0 mg/cm$^2$ depending on toner concentration, surface potential of photoreceptor, development potential, exposure value, transfer conditions, etc.

Then, the fixing machine in which a heat-fixing roller having a surface layer made of polytetrafluoroethylene and a pressure-fixing roller having a surface layer made of silicone rubber were rotated in pairs, was adjusted so as to have a roller pressure force of 1 Kgf/cm$^2$ and a roller speed of 125 mm/sec, a surface temperature of the heat-fixing roller was gradually increased in increments of 10° C. from 150° C. to 200° C., and the toner image on the transfer paper having the above unfixed image was thereby fixed at each of these surface temperatures.

An occurrence of toner contamination at a margin part was observed after fixing, and a temperature range in which the contamination did not occur was defined as a non-offset temperature range. In the non-offset temperature range, winding of the transfer paper having the unfixed image on the surface of the heat-fixing roll was observed, a temperature range in which the winding did not occur was defined as a non-winding temperature range, and the upper limit in the non-winding temperature range was confirmed.

2. Melt Contamination Resistance

The toners were put into a QMS2200 type printer (produced by Minolta QMS Co., Ltd.) of a nonmagnetic one-component developing method, an A4 size original having an image ratio of 5% was continuously copied on 5,000 sheets of A4 transfer paper. After copying 5,000 sheets, the presence of contamination by melted toner on a charging member (charging blade) of the printer was determined visually.

○: cases in which contamination by melted toner was not observed.

x: cases in which contamination by melted toner was observed.

3. Formability

A cross section in a vertical direction for extrusion direction of a resin composition plate (C) pushed out by a biaxial extruder was observed by an optical microscope (400 times magnification), and degree of kneading (degree of dispersion) of each material such as alicyclic olefinic resin (A), thermoplastic elastomer (B), colorant, wax, etc., was confirmed.

○: cases in which each material was uniformly and finely dispersed.

Δ: cases in which each material was uniformly dispersed but was not finely dispersed.

x: cases in which each material was not uniformly dispersed.

Production of Toners

Examples 1 to 4 and Comparative Examples 1 to 4

As a raw material of the toner, binding resin composed of alicyclic olefinic resin (A) and thermoplastic elastomer (B), colorant, charge control agent, and mold lubricant, were used at mixing ratios shown in Tables 1 and 2. in Comparative Examples 1 to 3, the binding resin consisting of only alicyclic olefinic resin (A) without thermoplastic elastomer (B) was used, and in Comparative Example 4, the binding resin consisting of only thermoplastic elastomer (B) was used.

Each of the above materials was melted and kneaded at a temperature of 160 to 200° C., the discharge rate of 3.5 kg/hr, and the rotational frequency of 250 rpm, using a biaxial kneading extruder (trade name: PCM-30, produced by Ikegai Corporation) and a melt-kneaded plate having a thickness of 2 to 3 mm was formed. A cross-section of the formed melt-kneaded plate was observed and formability of the each material was evaluated. Then, the melt-kneaded plate was crushed by a jet mill, and was classified by a dry-type air flow classifier, and toner particles having a volume average particle size of 8.5 μm was produced. Next, 0.3 weight % of hydrophobic silica having a volume average particle size of 40 nm (trade name: RY-50, produced by Nippon Aerosil Co., Ltd.) and 1.0 weight % of hydrophobic silica having a volume average particle size of 10 nm (trade name: H2000/4M, produced by Wacker Chemie GmbH) were added to the produced toner particle, and the mixture was agitated and mixed at a peripheral speed of 40 m/sec for 10 minutes by a Henschel mixer, and the toners of Examples 1 to 4 and Comparative Examples 1 to 4 were produced.

Fixability and melt contamination resistance of the produced toners were evaluated, and the results are shown in Tables 1 and 2.

TABLE 1

| | | | Example 1 | Example 2 | Example 3 | Example 4 |
|---|---|---|---|---|---|---|
| Material Composition | CO | Weight % | 84 | 84 | 86 | 84 |
| | TPO | Weight % | 5 | 0 | 0 | 3 |
| | TPEE | Weight % | 0 | 5 | 5 | 2 |
| | PIG. | Weight % | 5 | 5 | 5 | 5 |
| | CCA | Weight % | 2 | 2 | 2 | 2 |
| | WAX | Weight % | 4 | 4 | 2 | 4 |
| Fixability | Upper Limit of Winding Temperature | ° C. | 200 | 190 | 190 | 200 |
| Melt Contamination Resistance | Melt Contamination Resistance | — | ○ | ○ | ○ | ○ |
| Formability | Dispersability of Material | — | ○ | Δ | ○ | ○ |

TABLE 2

| | | | Comparative Example 1 | Comparative Example 2 | Comparative Example 3 | Comparative Example 4 |
|---|---|---|---|---|---|---|
| Material Composition | CO | Weight % | 89 | 91 | 86 | 0 |
| | TPO | Weight % | 0 | 0 | 0 | 0 |
| | TPEE | Weight % | 0 | 0 | 0 | 89 |
| | PIG. | Weight % | 5 | 5 | 5 | 5 |
| | CCA | Weight % | 2 | 2 | 2 | 2 |
| | WAX | Weight % | 4 | 2 | 7 | 4 |
| Fixability | Upper Limit of Winding Temperature | ° C. | 170 | 150 | 180 | Occurrence of Offset at 150° C. |
| Melt Contamination Resistance | Melt Contamination Resistance | — | X | ○ | X | X |
| Formability | Dispersability of Material | — | Δ | ○ | X | ○ |

As is apparent from Tables 1 and 2, the toners of Examples 1 to 4 of the present invention were superior in various properties such as fixability, melt contamination resistance, and formability.

In contrast, in the toner of Comparative Example 1, the upper limit of the non-winding temperature range was low, and the melt contamination resistance was also inferior in comparison with the Examples since the thermoplastic elastomer (B) was not contained. In the toner of Comparative Example 2, the melt contamination resistance and formability were superior, but the upper limit of the non-winding temperature range was low, since the thermoplastic elastomer (B) was not contained, but the content of the wax was lower than that in the toner of Comparative Example 1. In the toner of Comparative Example 3, the upper limit of the non-winding temperature range was high, but the melt contamination resistance and formability were inferior since the content of wax was higher than that in the toner of Comparative Example 1. In the toner of Comparative Example 4, the offset occurred at 150° C., and the melt contamination resistance was inferior, since the alicyclic olefinic resin (A) was not contained.

The invention claimed is:

1. A toner for developing electrostatic charge images, comprising at least:

binder resin containing alicyclic olefinic resin (A), the alicyclic olefinic resin (A) being made by copolymerizing cyclic olefin (A1) and acyclic unsaturated olefinic monomer (A2), and thermoplastic elastomer (B), wherein a ratio ((A)/(B)) between the alicyclic olefinic resin (A) and the thermoplastic elastomer (B) is 70/30 to 99.5/0.5;

colorant; and wax in an amount of 0.1 to 5 weight %.

2. The toner for developing electrostatic charge images according to claim 1, wherein the thermoplastic elastomer (B) is at least one elastomer selected from the group consisting of olefinic elastomer, polyamide elastomer, polyester elastomer, and styrenic elastomer.

3. The toner for developing electrostatic charge images according to claim 1, wherein a melting point of the thermoplastic elastomer (B) is from 60 to 190° C.

4. The toner for developing electrostatic charge images according to claim 1, wherein a ratio (Ma/Mb) of a melt flow rate (Ma) of the alicyclic olefinic resin (A) and a melt flow rate (Mb) of the thermoplastic elastomer (B) is 0.1 to 20.

5. The toner for developing electrostatic charge images according to claim 1, further comprising color pigment.

6. The toner for developing electrostatic charge images according to claim 1, wherein the wax is contained in an amount of 1 to 5 weight %.

7. The toner for developing electrostatic charge images according to claim 1, wherein the ratio ((A)/(B)) between the alicyclic olefinic resin (A) and the thermoplastic elastomer (B) is 80/20 to 99/1.

8. The toner for developing electrostatic charge images according to claim 1, wherein the ratio ((A)/(B)) between the alicyclic olefinic resin (A) and the thermoplastic elastomer (B) is 90/10 to 99/1.

9. A toner for developing electrostatic charge images by a non-magnetic one-component developing method, comprising at least:

binder resin containing alicyclic olefinic resin (A), the alicyclic olefinic resin (A) being made by copolymerizing cyclic olefin (A1) and acyclic unsaturated olefinic monomer (A2), and thermoplastic elastomer (B), wherein a ratio ((A)/(B)) between the alicyclic olefinic resin (A) and the thermoplastic elastomer (B) is 70/30 to 99.5/0.5;

colorant; and wax in an amount of 0.1 to 5 weight %.

* * * * *